US005934692A

United States Patent [19]

Artus

[11] Patent Number: 5,934,692

[45] **Date of Patent: *Aug. 10, 1999**

[54] ROLLER SKATE OR ICE SKATE FITTED WITH DAMPING MEANS

[76] Inventor: Jean-Pierre Artus, 20, rue du Lanfrey, 38120 Le Fontanil, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/762,096

[22] Filed: Dec. 9, 1996

[30] Foreign Application Priority Data

Dec. 11, 1995 [FR] France ..... 95 14824

[51] Int. Cl.[6] ..... A63C 17/02

[52] U.S. Cl. ..... 280/11.22; 280/11.28

[58] Field of Search ..... 280/11.19, 11.22, 280/11.27, 11.28

[56] References Cited

U.S. PATENT DOCUMENTS

| | | | |
|---|---|---|---|
| 241,270 | 5/1881 | Akin | 280/11.28 |
| 584,089 | 6/1897 | Buttermilch | 280/11.23 |
| 2,644,692 | 7/1953 | Kalhert | 280/11.22 |
| 2,726,873 | 12/1955 | Wooley | 280/11.28 |
| 4,666,168 | 5/1987 | Hamill et al. | 280/11.2 |
| 4,711,458 | 12/1987 | Shim | 280/11.22 |
| 5,143,388 | 9/1992 | Chen | 280/11.28 |
| 5,330,208 | 7/1994 | Charron et al. | 280/11.22 |
| 5,342,071 | 8/1994 | Soo | 280/11.22 |
| 5,398,948 | 3/1995 | Mathis | 280/11.19 |
| 5,411,278 | 5/1995 | Wittman | 280/11.22 |
| 5,474,310 | 12/1995 | Chen | 280/11.22 |
| 5,536,025 | 7/1996 | Landay | 280/11.22 |
| 5,685,551 | 11/1997 | Zorzi et al. | 280/11.22 |
| 5,772,220 | 6/1998 | Gaster | 280/7.1 |

FOREIGN PATENT DOCUMENTS

| | | | |
|---|---|---|---|
| A 602 148 | 6/1976 | Switzerland | 280/11.22 |
| 834 131 | 11/1957 | United Kingdom . | |

*Primary Examiner*—J. J. Swann
*Assistant Examiner*—James S. McClellan
*Attorney, Agent, or Firm*—Bugnion S.A.; John Moetteli

[57] ABSTRACT

A roller skate of ice skate with a rigid chassis (2) and fitted with at least one vibration damper device (6). This damper device (6) is bonded to the chassis (2) and consists of at least one viscoelastic material (62) bonded to at least one rigid stress plate (61). The damping is intended to eliminate the acoustic and mechanical problems which are due to the high-frequency vibrations of the chassis. The damper device (6) is preferably fixed on a vibration antinode of the chassis.

17 Claims, 5 Drawing Sheets

FIG. 2
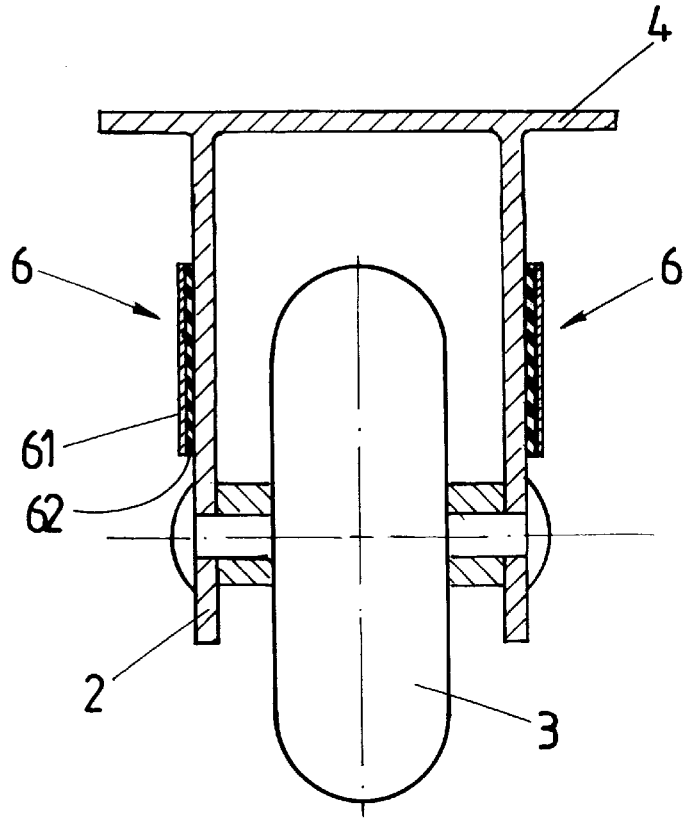
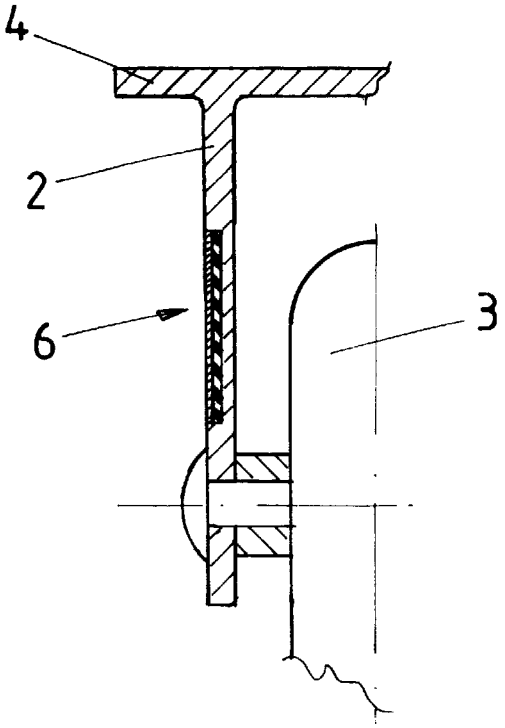
FIG. 3

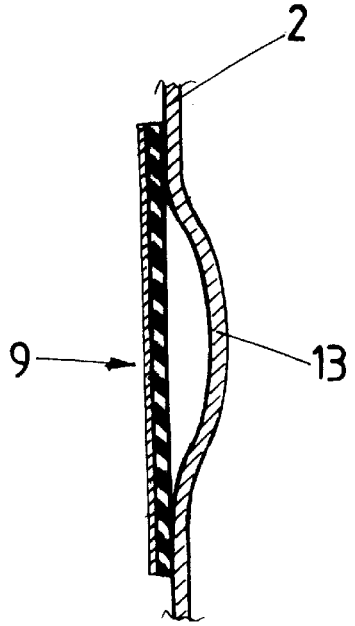
FIG.7
FIG.9
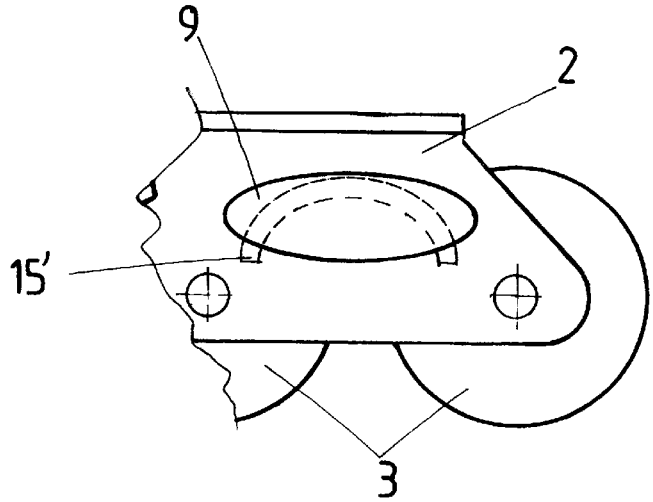
FIG.8
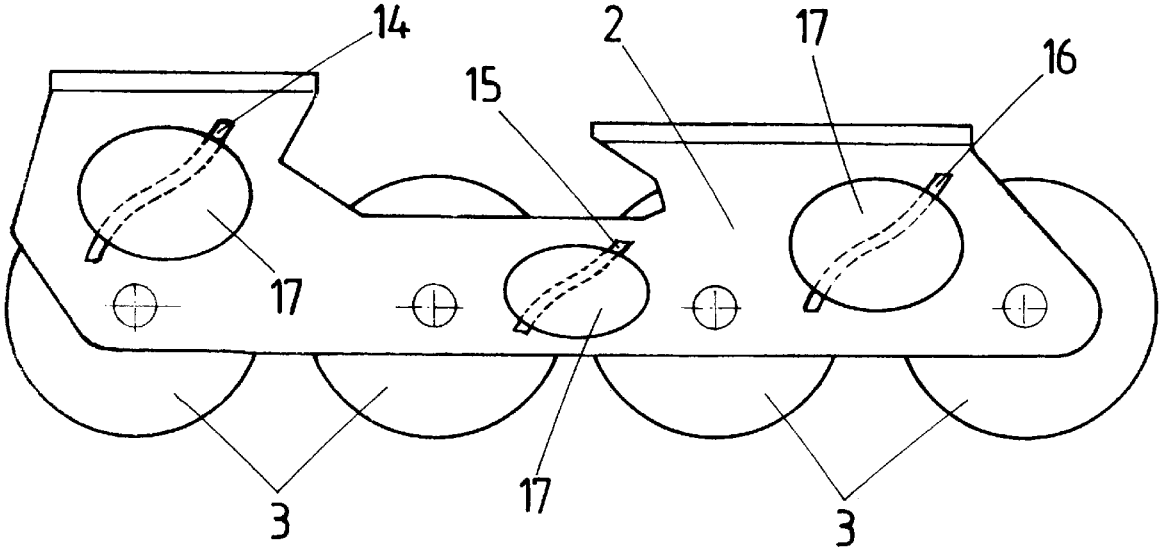

FIG.10
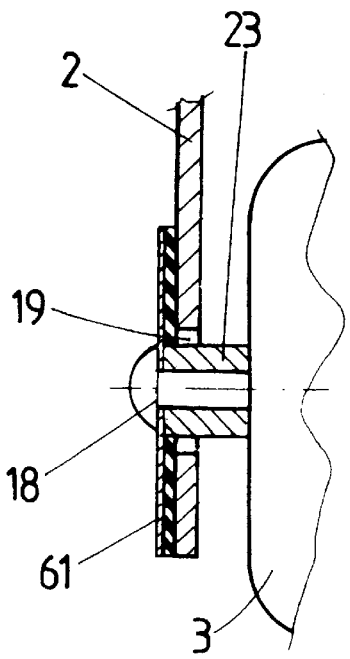
FIG.12
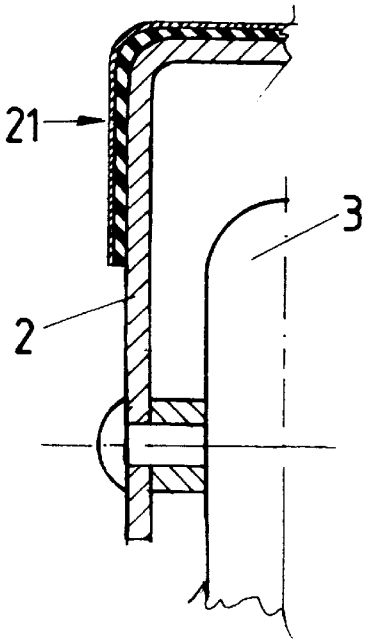
FIG.13
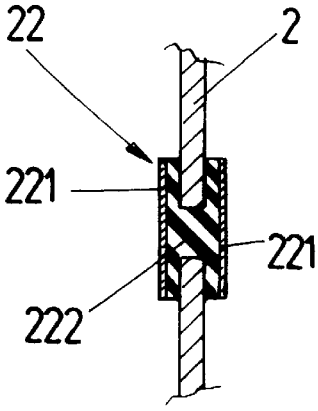
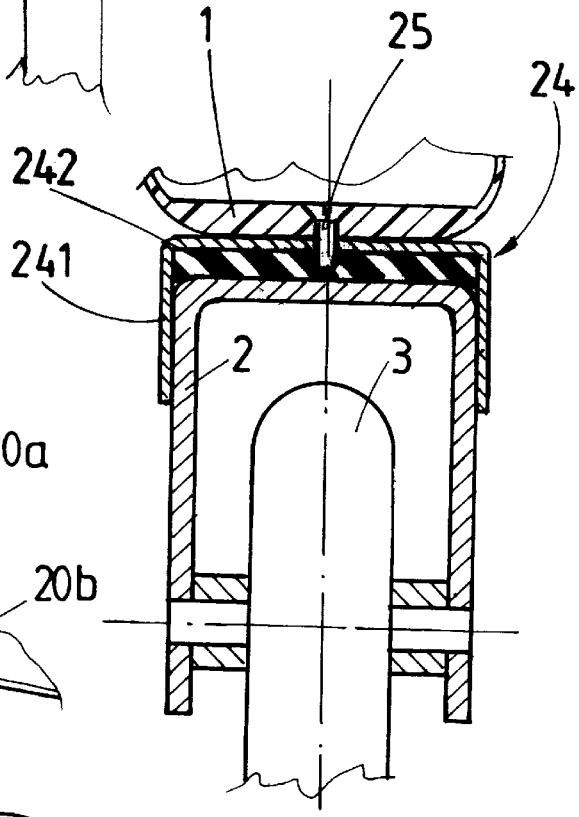
FIG.14
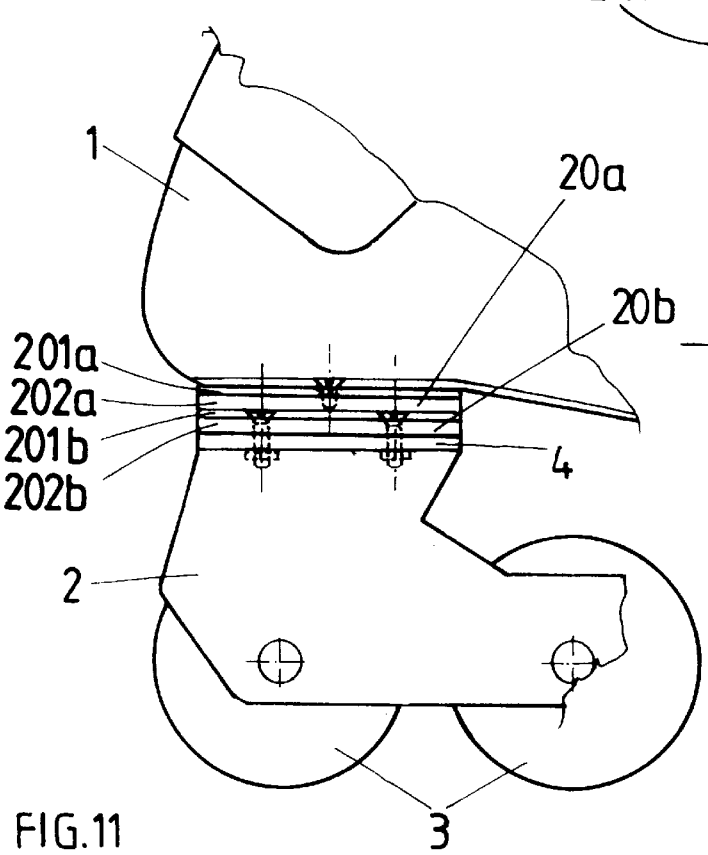
FIG.11

ROLLER SKATE OR ICE SKATE FITTED WITH DAMPING MEANS

FIELD OF THE INVENTION

The subject of the present invention is a skate, in particular a roller skate or ice skate, with a rigid chassis and equipped with a vibration damper device.

PRIOR ART

An in-line roller skate with a rigid chassis is described, for example, in the document DE-U-295 09 421. The chassis of this in-line roller skate has a U-shaped profile supporting two platforms on which the heel and the toe of a boot are respectively fixed.

The surfaces on which a roller skate runs are not generally perfectly smooth, but instead have surface roughness of which the irregularities, with varying size, cause a rapid succession of shocks on the skate which lead to vibrations of the rigid chassis. Depending on the nature of the ground and the speed of the skate, the frequency of these shocks may be close to the resonant frequency of the chassis of the skate, which has the effect of increasing the amplitude of the vibrations. The frequency of these vibrations may reach an audible value and thereby create acoustic pollution in the neighborhood. These vibrations are also transmitted to the skater's feet and legs. These vibrations therefore constitute a problem for comfort. The same may be true as regards ice skates.

With the aim of damping certain vibrations, it has already been proposed to fix an elastic blade, fitted with a mass, to the sole of the boot (U.S. Pat. No. 5,398,948). However, a device of this type does not allow effective damping of the high frequency vibrations of the chassis, in particular the vibrations with sonic frequencies. In addition, its location does not allow the vibrations to be damped at the appropriate locations, that is to say where the vibration antinodes are found.

SUMMARY OF THE INVENTION

The object of the invention is effectively to neutralize the vibrations of the chassis, and consequently to eliminate the acoustic and mechanical problem which is due to these high frequency vibrations.

The skate according to the invention is one wherein the vibration damper device is fixed to the chassis and consists of at least one viscoelastic material combined with at least one rigid stress plate.

The rigid stress plate is preferably fixed to the chassis via the viscoelastic material.

On condition that the vibration antinodes are locatable on the chassis, the damper device or devices will preferably be adhesively bonded at the location of these antinodes.

The stress plate will advantageously have a modulus of elasticity E greater than $10^4$ MPa and a thickness of between 0.1 and 2.5 mm, and advantageously the viscoelastic material will be chosen from the group comprising butyl rubbers and synthetic elastomers, individually or as a mixture or containing fillers.

Two damper devices in platelet form may be interposed between the chassis platforms and the boot, so as not only to damp the vibrations of the chassis but also to prevent the vibrations from being transmitted to the boot.

BRIEF DESCRIPTION OF THE DRAWINGS

By way of example, the appended drawing represents some embodiments of the invention.

FIG. 2 is a view in section on II—II in FIG. 1.

FIG. 3 is a half section, similar to FIG. 2, illustrating a variant of the first embodiment.

FIG. 7 represents a second variant of the embodiment represented in FIG. 5.

FIG. 8 represents a chassis according to a fourth embodiment.

FIG. 9 represents a chassis portion according to a variant of the fourth embodiment.

FIG. 10 represents a fifth embodiment, in which the damper element is used as a bearing.

FIG. 11 is a partial view of a skate according to sixth embodiment.

FIG. 12 represents a half-section of a chassis according to FIG. 1, fitted with a damper device according to a seventh embodiment.

FIG. 13 represents an eighth embodiment.

FIG. 14 represents a ninth embodiment.

DESCRIPTION OF THE PREFERRED EMBODIMENTS

Figure 1:
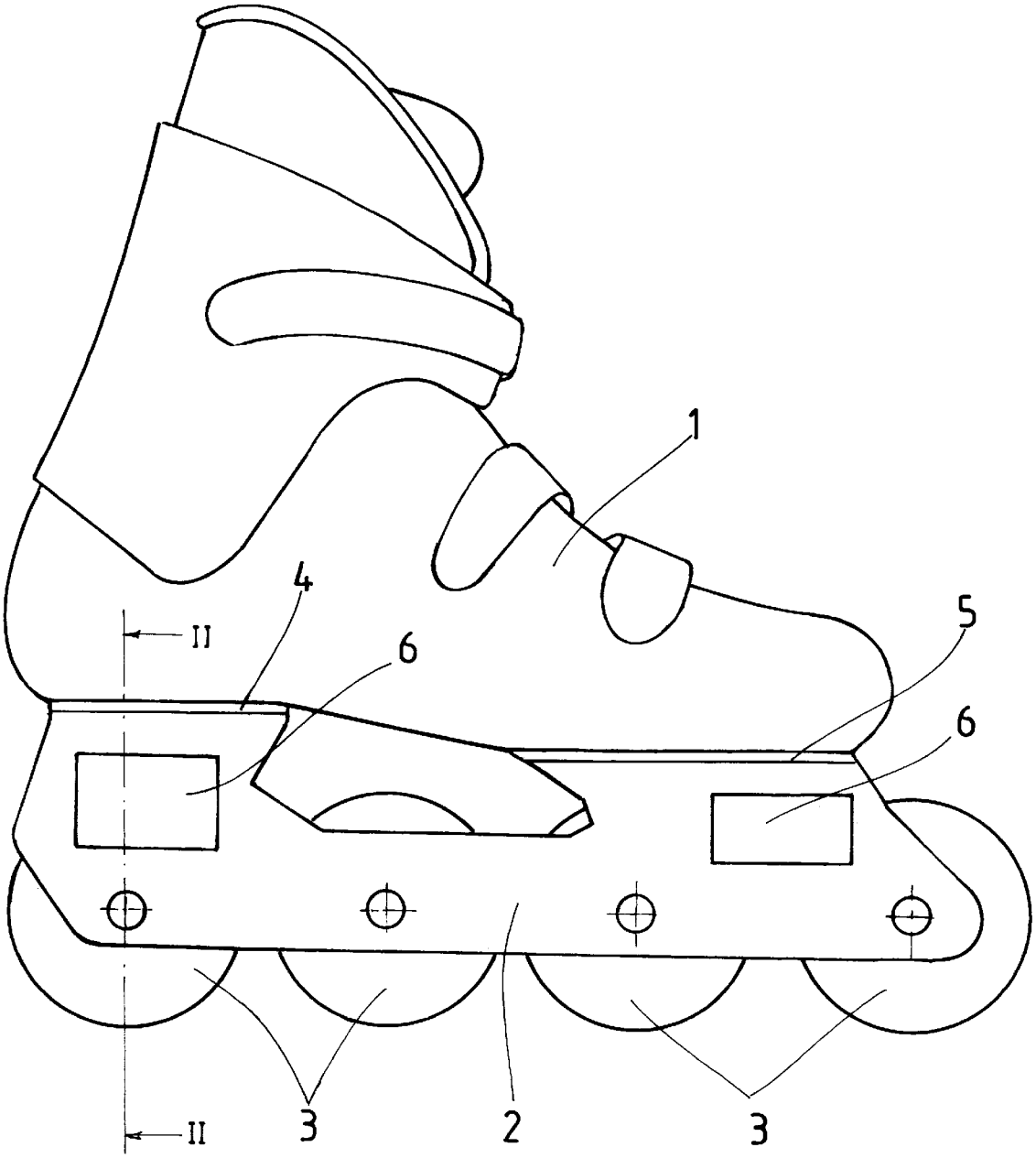
FIG. 1 represents a first embodiment which requires no modification to the chassis of existing skates.

FIG. 1 represents an in-line roller skate consisting of a boot 1 mounted on a rigid chassis 2, for example made of metal, supporting four in-line rollers 3. Under the heel and under the anterior part of the boot, the chassis 2 has a U-shaped profile which widens so as to form a rear platform 4 and a front platform 5 which are intended to support the boot securely. The chassis 2 is fitted with two pairs of damper devices 6, the devices in each pair being arranged symmetrically on the two opposite sides of the chassis, as represented in FIG. 2. These damper devices each consist of a rigid stress plate 61 on which a layer of viscoelastic material 62 is adhesively bonded. The thicknesses represented are not the true thicknesses. The rigid plate 61 advantageously has a modulus of elasticity E greater than $10^4$ MPa and a thickness of between 0.1 and 2.5 mm, preferably between 0.3 and 2 mm, for example 1 mm. The material of the rigid plate 61 is chosen from the group comprising aluminum alloys, the aluminum-zinc-magnesium alloys known by the registered trademark ZYCRAL of the CEGEDUR-PECHINEY company, laminated thermosets reinforced with glass or carbon fibers, and thermoplastics reinforced with glass or carbon fibers.

The viscoelastic material 62 is, for example, a butyl rubber or a synthetic elastomer, such as NEPURANE PI 2010, these being used individually, as a mixture or containing fillers. The viscoelastic element 62 may consist of an elementary sheet or of a stack of a plurality of elementary viscoelastic sheets with the same characteristic or different characteristics. In the latter case, the damping properties of each of the sheets will be temperature-shifted for a given vibrational frequency or frequency-shifted for a given temperature, so as to take into account the variation in the natural frequency of the chassis as a function of temperature. The thickness of the viscoelastic layer 62 is 1 to 2 mm.

The viscoelastic material 62 is adhesively bonded to the chassis 2 or fixed to it by vulcanization, if the material employed allows this. The damper devices are preferably fixed on the vibration antinodes. Since vibrations can occur in different directions, the damper devices may be fixed in different directions, and therefore also on the horizontal parts of the chassis.

The chassis could be made of a nonmetallic rigid material, for example of carbon fibers.

According to the variant represented in FIG. 3, the damper devices 6 are adhesively bonded in a hollow formed in the chassis 2, so as not to form any projection at the surface of the chassis.

Figure 4:
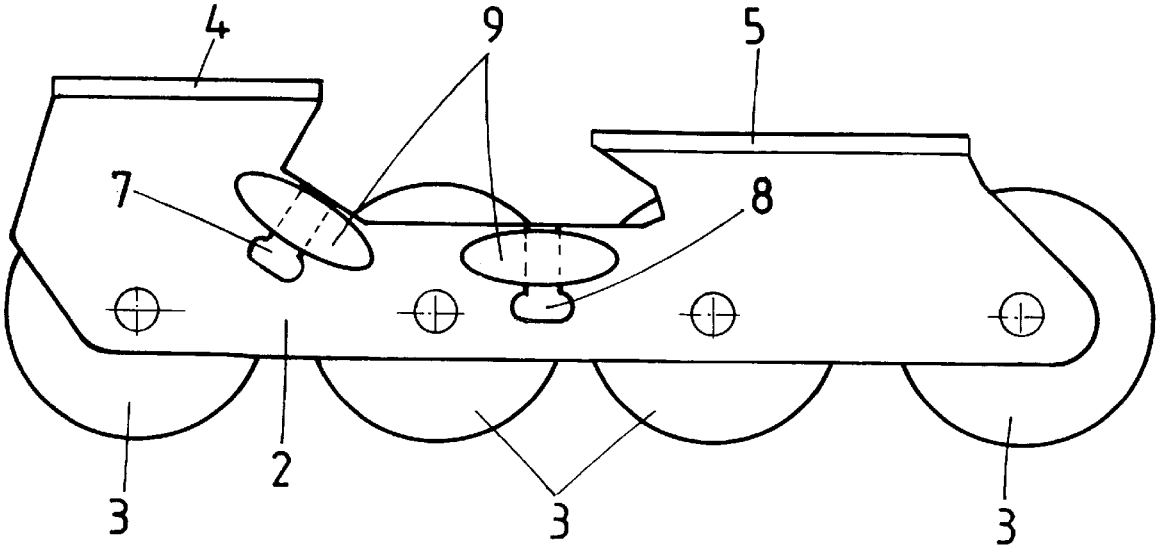
FIG. 4 represents a chassis according to a second embodiment.

In the embodiment represented in FIG. 4, the lateral parts of the chassis 2 have, between the platforms, notches 7, 8 which open on the upper edges of the chassis. These notches constitute reduced-strength regions which give the chassis a degree of flexibility. Damper devices of the same type as those described before are fixed across these notches. The damper devices 9 also have the effect of absorbing the vibrations resulting from the flexural stressing of the chassis at the notches 7 and 8.

Figure 5:
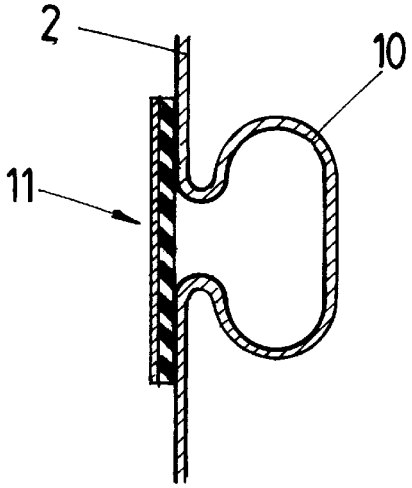
FIG. 5 is a view in section through a portion of a sidewall of the chassis of a skate according to a third embodiment.

FIG. 5 partially represents an embodiment in which the lateral parts of the chassis 2 have rounded hollow folds 10 in the shape of an Ω. These folds 10 also create regions with reduced strength in the direction perpendicular to the axis of the folds. Damper devices 11 of similar structure to the devices 6 are adhesively bonded on and across these folds.

Figure 6:
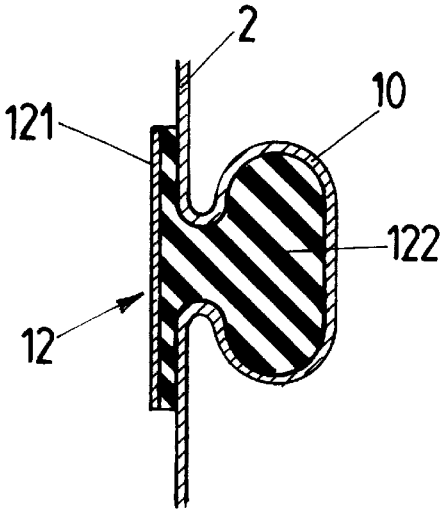
FIG. 6 represents a variant of the embodiment represented in FIG. 5.

FIG. 6 represents a variant of the embodiment represented in FIG. 5, in which variant the viscoelastic material 122 of a damper device 12 fills the fold 10. As in the preceding embodiments, a rigid platelet 121 is adhesively bonded on the viscoelastic material 122. In this case, two damping effects are combined: on the one hand, shearing at the stress plate and, on the other hand, the compressive deformation of the rubber when the fold 10 deforms.

FIG. 7 represents a second variant of the embodiment according to FIG. 5, in which variant the fold 10 is replaced by an undulation 13 across which a planar damper device 9, similar to the damper devices of the first embodiment, is adhesively bonded. The visoelastic material could also fill the undulation. Advantageously, the thickness of the chassis 2 at the center of the undulation 13 could be reduced so as to promote deformation.

In the embodiment represented in FIG. 8, the chassis 2 has closed-contour slots 14, 15, 16, slightly in the shape of an S. These slots fulfill the same role as the notches 7 and 8 in FIG. 4. Damper devices 17 of the same design as the devices 6 in the first embodiment are adhesively bonded across these slots. The slots are preferably placed between the rollers.

The closed-contour slots may have a different shape. FIG. 9 represents a variant in which the slots 15' have a semi-elliptical or half basket-handle shape and extend between two axles of the rollers. The slots 15' preferably extend above the axles of the rollers, so as to create a flexion region which employs the inherent elasticity of the chassis.

The damper devices may have a second function. FIG. 10 illustrates the use of damper elements 6 as a support for the rollers 3. The axle 18 of the rollers is enclosed by a spacer 23 which passes through the chassis 2 with a clearance 19, as well as through the viscoelastic material and bears against the stress plate 61 of the damper device. The axle 18 is supported by the rigid stress plate 61. In this embodiment, the damper device 6 therefore also damps the transmission of the vibrations from the axle 18 to the chassis 2.

Damper devices may also be fixed on the platforms 4 and 5 of the chassis. FIG. 11 represents the rear of a skate produced according to this method. In order to isolate the boot 1 mechanically from the chassis 2, use is made of two superposed damper devices 20*a* and 20*b* which have the same structure as the damper devices in the preceding embodiments. The stress plate 201*b* of the lower damper device 20*b* is fixed to the platform 4 non only by adhesively bonding its viscoelastic material 202*b*, but also by screws which bear on the stress plate 201*b* of this damper element. The boot 1 is fixed by means of screws screwed into the stress plate 201*a* of the upper damper device 20*a* fixed on the stress plate 201*b* of the lower device by its viscoelastic material 202*a*. This provides not only damping of the vibrations of the chassis 2, but also damping of the transmission of the vibrations from the chassis 2 to the boot.

FIG. 14 represents a simplified version, comprising a single damper device 24 consisting of a stress plate 241 and of a viscoelastic element 242. The stress plate may have two wings which enclose the chassis 2 in stirrup fashion. The boot 1 is fixed to the stress piece 241 by at least one screw 25. The stress piece 241 provides good lateral holding of the boot on the chassis.

As already shown by FIG. 6, the damper device need not necessarily be in the form of a planar platelet. This platelet may instead be curved in order to match curvature of the chassis. By way of example, FIG. 12 represents a damper element 21 in the shape of a bracket covering the corner of the U-shaped profile constituting the chassis. A shape of this type effectively damps vibrations in different planes.

Under certain conditions, the viscoelastic material may also be sandwiched between two stress plates. An example is represented in FIG. 13. The chassis 2 is provided with notches similar to the notches 8 in FIG. 4. Damper devices 22, the viscoelastic material 222 of which has a H-shaped profile, are inserted into these notches. A stress plate 221 is fixed on the two sides of the H.

The damper device 22 in FIG. 13 could also be used with a single stress plate 221, with the shape of the viscoelastic material 222 simply providing fastening by interlocking and anchoring to the chassis 2.

FIG. 14 represents a damper device 24 consisting of a relatively thick block of viscoelastic material 242 combined with a rigid stress plate 241 in the shape of U, the wings of which are extended below the viscoelastic material and enclose the chassis 2 in stirrup fashion. The boot 1 is fixed to the stresspiece 241 by at least one screw 25. The stresspiece 241 provides good lateral holding of the boot on the chassis, while the viscoelastic material 242 further ensures good damping of the transmission of the vibrations from the chassis to the boot.

I claim:

1. A skate, in particular a roller skate or ice skate, with a rigid chassis (2) and equipped with a vibration damper device, wherein the vibration damper device (6; 9; 11; 12; 17; 20; 21; 22; 24) is bonded to on the chassis (2) and consists of at least one viscoelastic material (62; 202; 222) combined with at least one rigid stress plate (61; 121; 201; 221; 241) bonded to the viscoelastic material, the rigid stress plate (61; 121; 201; 221; 241) being fixed to the chassis via the viscoelastic material only, wherein the vibration damper device primarily dampens high-frequency vibrations through inducing shearing stresses which act in a direction substantially parallel to the stress plate, and wherein the vibration damper device does not primarily have the function of a shock absorber.

2. The skate as claimed in claim 1, wherein the rigid stress plate has a modulus of elasticity E greater than $10^4$ MPa and a thickness of between 0.1 and 2.5 mm, preferably between 0.3 and 2 mm.

3. The skate as claimed in claim 1, wherein the viscoelastic material is chosen from the group comprising butyl rubbers and synthetic elastomers, individually or as a mixture or containing fillers.

4. The skate as claimed in claim 1, wherein the chassis (2) has at least one reduced-strength region (8; 10; 13; 15; 15') which can deform under load, and wherein the damper device (9; 11; 12; 17; 22) is fixed in this region.

5. The skate as claimed in claim 4, wherein the reduced-strength region is a notch (8) which opens onto the upper side of the chassis, and wherein the damper device (9; 22) is fixed across this notch.

6. The skate as claimed in claim 4, wherein the reduced-strength region is a closed-contour slot (15; 15'), in particular in the shape of an S or a C, and wherein the damper device (9; 17) is fixed across this slot.

7. The skate as claimed in claim 1, wherein the chassis (2) has at least one rounded open fold (10) in the shape of an Ω, and wherein the damper device (11; 12) is fixed across the opening of this fold.

8. The skate as claimed in claim 1, wherein the chassis has at least one undulation (13), and wherein the damper device (9) is fixed across this undulation.

9. The skate as claimed in claim 7, wherein the viscoelastic material (122) fills the fold.

10. The skate as claimed in claim 8, wherein the viscoelastic material (122) fills the undulation.

11. The skate as claimed in claim 1, the rigid chassis of which has a U-shaped profile and supports a boot (1), which skate comprises at least one damper device (24) consisting of a rigid stress plate (241) and of a viscoelastic material (242) between the rigid stress plate and the top of the chassis, and wherein the boot (1) is fixed on the rigid stress plate.

12. The skate as claimed in claim 11, wherein the stress plate (241) is provided with two wings descending on each side of,the chassis (2).

13. The skate as claimed in claim 1, the chassis of which has two platforms (4, 5) for binding a boot (1), wherein on at least one of the platforms a first damper device in the form of a plate **(20*b*) is fixed on the platform, and wherein a second damping device, in the form of a plate (20*a*) is fixed, on the one hand, via the viscoelastic material (202*a*) on the first plate and, on the other hand, to the boot by at least one screw screwed essentially into the stress plate (201*a*)** of this second damper device.

14. An in-line roller skate as claimed in claim 1, wherein at least one axle (18) of the rollers passes, with clearance (19) through the chassis and is fixed on the stress plate (61) of a damper device.

15. The skate as claimed in claim 1, the rigid chassis of which has a U-shaped profile, wherein the damper element is in the form of a plate (21), bent at 90°, covering a corner of the profile.

16. The skate as claimed in claim 1, wherein the viscoelastic material (222) is sandwiched between two stress platelets (221).

17. The skate as claimed in claim 1, wherein the damper elements (22) are fixed to the chassis by interlocking or anchoring.

* * * * *

UNITED STATES PATENT AND TRADEMARK OFFICE

CERTIFICATE OF CORRECTION

PATENT NO : 5,934,692

DATED : AUGUST 10, 1999

INVENTOR(S) : ARTUS

It is certified that error appears in the above-identified patent and that said Letters Patent is hereby corrected as shown below:

Title page, column 2, first line of abstract, replace «of» with -or--.

Signed and Sealed this

Fourth Day of April, 2000

*Attest:*

*Attesting Officer*

Q. TODD DICKINSON

*Director of Patents and Trademarks*

UNITED STATES PATENT AND TRADEMARK OFFICE

CERTIFICATE OF CORRECTION

PATENT NO. : 5,934,692
DATED : AUGUST 10, 1999
INVENTOR(S) : ARTUS

It is certified that error appears in the above-identified patent and that said Letters Patent is hereby corrected as shown below:

On the front page, column 1, between listed item "[76]... France" and "[*]", please insert:
--[73] Assignee: Skis Rossignol S.A., Voiron, France--

Signed and Sealed this

Eleventh Day of July, 2000

*Attest:*

Q. TODD DICKINSON

*Attesting Officer*

*Director of Patents and Trademarks*